US006230879B1

(12) United States Patent
Lin

(10) Patent No.: US 6,230,879 B1
(45) Date of Patent: May 15, 2001

(54) STRUCTURE OF NAME CARDS BOX

(76) Inventor: Chang-Yi Lin, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/489,704

(22) Filed: Jan. 21, 2000

(51) Int. Cl.[7] ..... B65D 85/00
(52) U.S. Cl. ..... 206/39.4
(58) Field of Search ..... 206/39, 39.4–39.6

(56) References Cited

U.S. PATENT DOCUMENTS

| | | | | |
|---|---|---|---|---|
| 1,658,496 | * | 2/1928 | Qvarnstrom | 206/39.4 |
| 3,730,602 | * | 5/1973 | Campbell et al. | 206/309 |
| 4,852,727 | * | 8/1989 | Oberle | 206/39.4 |
| 4,934,520 | * | 6/1990 | Okada | 206/39 |
| 5,265,721 | * | 11/1993 | Castritis | 206/309 |
| 5,353,956 | * | 10/1994 | Wilson | 206/800 |
| 5,402,095 | * | 3/1995 | Janniere | 206/39.6 |

* cited by examiner

*Primary Examiner*—Jim Foster

(57) ABSTRACT

A name cards box which includes a bottom box, a top cover, a sliding piece and a spring. The top cover includes a downwardly extending circumferential edge and an opening within one of the sides of the circumferential edge. An indented opening is located at a corner next to the side opening and is indented with respect to the side opening, for receiving a bent stopping piece of the sliding piece. A trough opening is located near the indented opening and includes stops at each end thereof. The bottom box includes a circumferential frame and an opening in a side of the frame which corresponds to the opening in the circumferential edge of the top cover to permit card removal. An additional opening in the box bottom frame corresponds to the trough opening in the top cover to movably receive a block of the sliding piece. Movement of the block is limited by the stops of the trough opening The bottom box also includes a hole and a recessed areas for slidably receiving the sliding piece. The sliding piece has hooks for pushing the cards out of the box. Upon pushing the of the sliding piece to permit removal of certain cards from the box, the spring urges the sliding piece back to its original position.

3 Claims, 7 Drawing Sheets

STRUCTURE OF NAME CARDS BOX

BACKGROUND OF THE INVENTION

The present invention relates to a name cards box, and more particularly to a name cards box which name cards can be pushed outside the name cards box.

Figure 1:
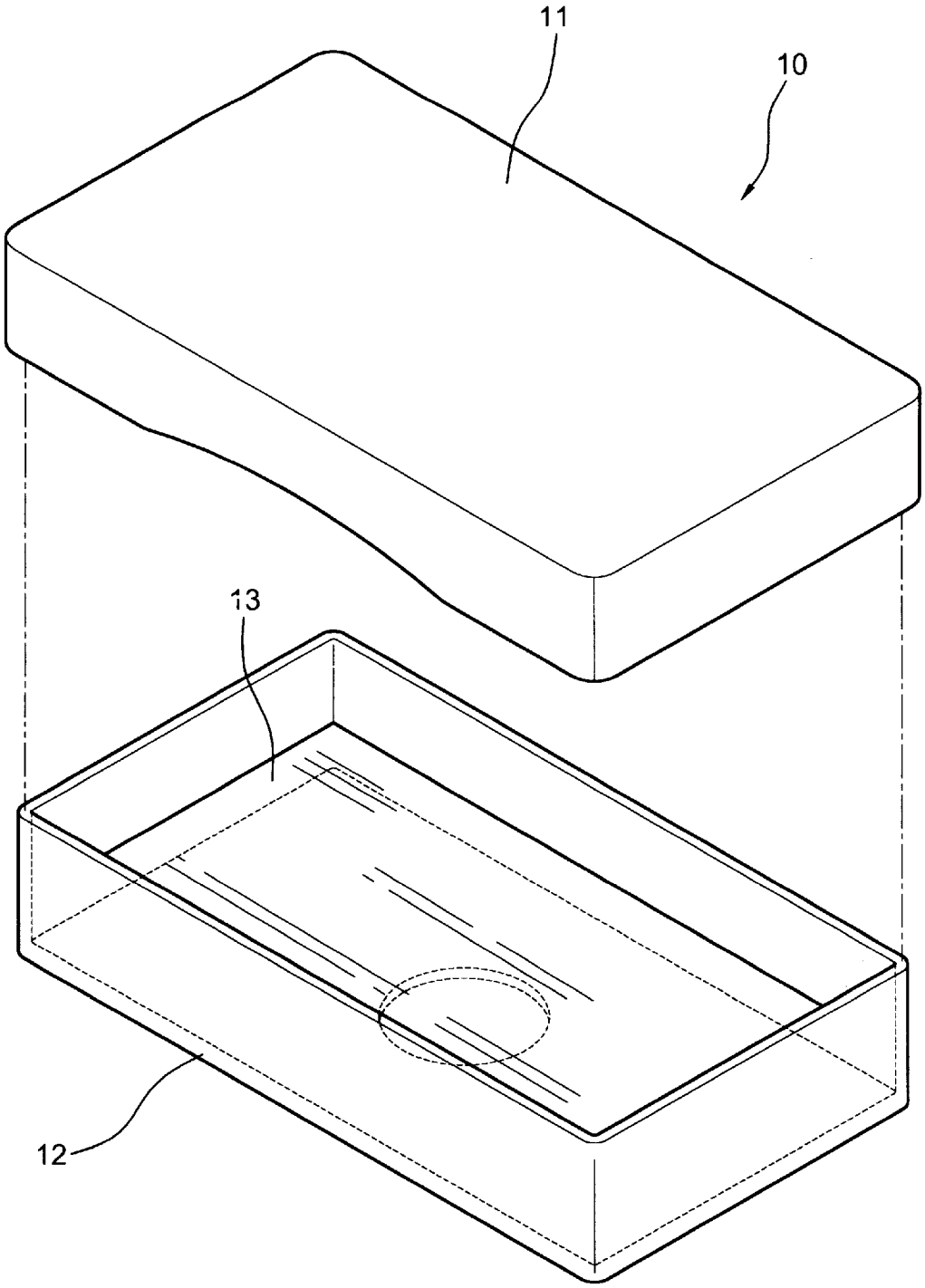
FIG.1 Prior Art

Conventionally, users need to open the name cards box in order to get name cards out. As shown in FIG. 1, a conventional name cards box 10 comprises a top cover 11 and a bottom box 12. The bottom box 12 can accommodate name cards 13. The top cover 11 covers the bottom box 12, when users need to get out the name cards 13, first of all, need to take away the top cover 11 and put it aside, then get the name cards 13 out. The name cards box 10 is only a body in box shape and doesn't have any other special functions.

SUMMARY OF THE PRESENT INVENTION

The present invention relates to structure of a name cards box and it mainly comprises a top cover, in which the top cover extends downwardly a circumference edge from its four sides, a slit opening is disposed at one side, the slit opening is narrower than the circumference edge from which name cards are taken out. An indented opening is just at the corner right next to the slit opening. A trough with stopping edge on its both ends is disposed next to the indented opening; A bottom box with a convex edge and a circumference frame are on its sides. The circumference edge of the top cover just matches with the circumference frame of the bottom box. A slit is disposed just in correspondence to the slit opening of the top cover. There is no circumference frame in correspondence to the trough. A hole is disposed on the bottom box at a preset place, both ends by the hole on the bottom of the bottom box are a little lower than the rest area of the bottom of the bottom box; A sliding piece is placed inside the hole and on top of the lower areas by both ends of the hole. The sliding piece comprises a lower main board with three hooks at one end. Each hook has a hooking end, one of the three hooks is a little bent upwards. A flat board is disposed at the opposite end of the main board. A block is found on one side of the flat board with a rod extended from it, a stopping piece is disposed at the end of the rod. The stopping piece can go in and out of the indented opening of the top cover, the block moves within the trough and is limited by the stopping edges of the top cover.

Accordingly, the sliding piece is slid within the hole of the bottom box by fingers. The stopping piece doesn't block the intended opening and name cards are hooked out by the hooks through between the slit opening of the top cover and the slit of the bottom box. Thus accomplished is the purpose of taking out and pushing back name cards from the name cards box conveniently. The main objective of the present invention of a name cards box structure is to provide a means of pushing out name cards from the name cards box by a sliding piece without having to open the top cover of the name cards box. A wanted number of name cards can also be more accurately taken out.

The present invention will become more fully understood by reference to the following detailed description thereof when read in conjunction with the attached drawings.

BRIEF DESCRIPTION OF THE PRAWINGS

Figure 2:
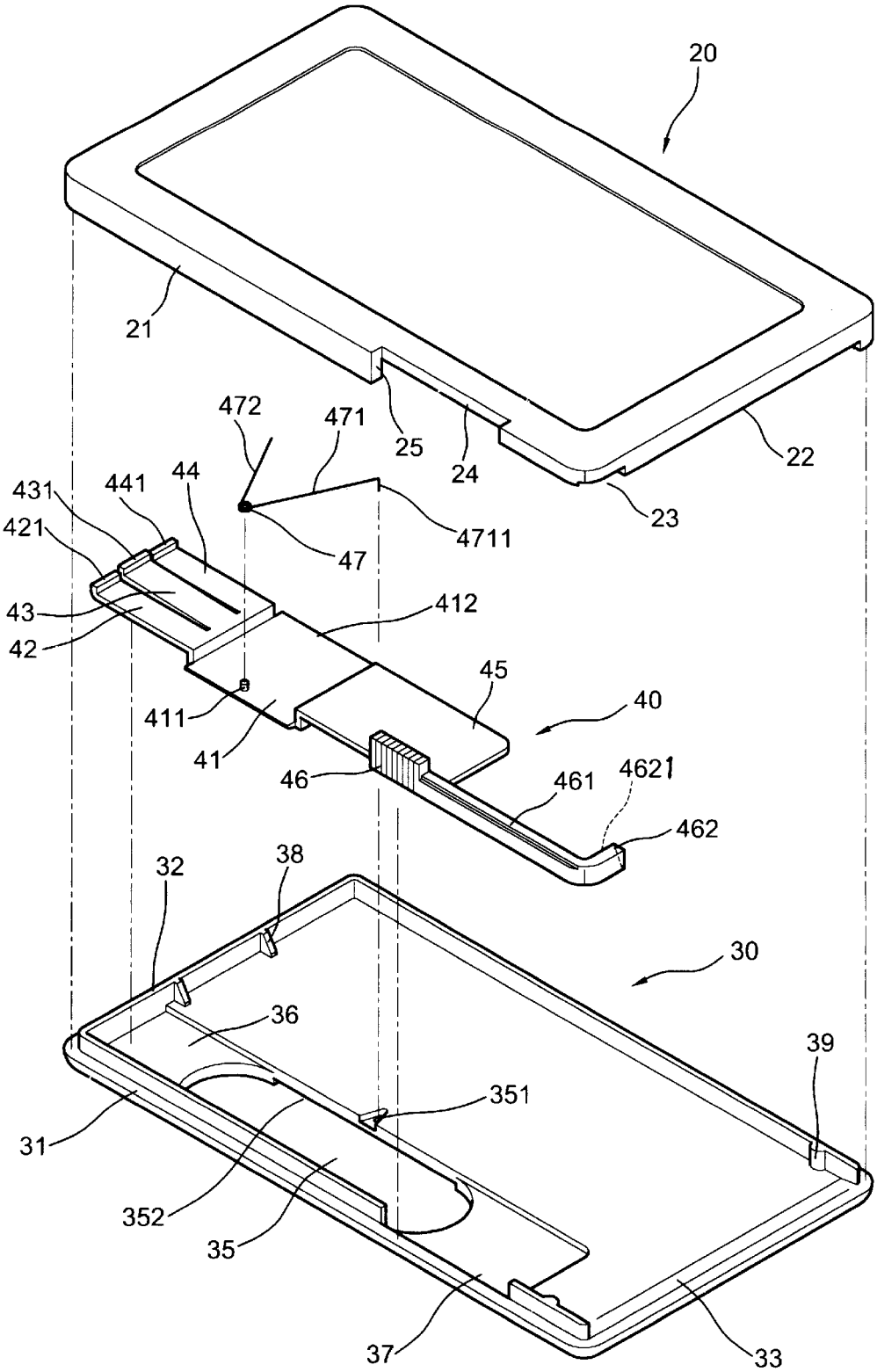
Figure 3:
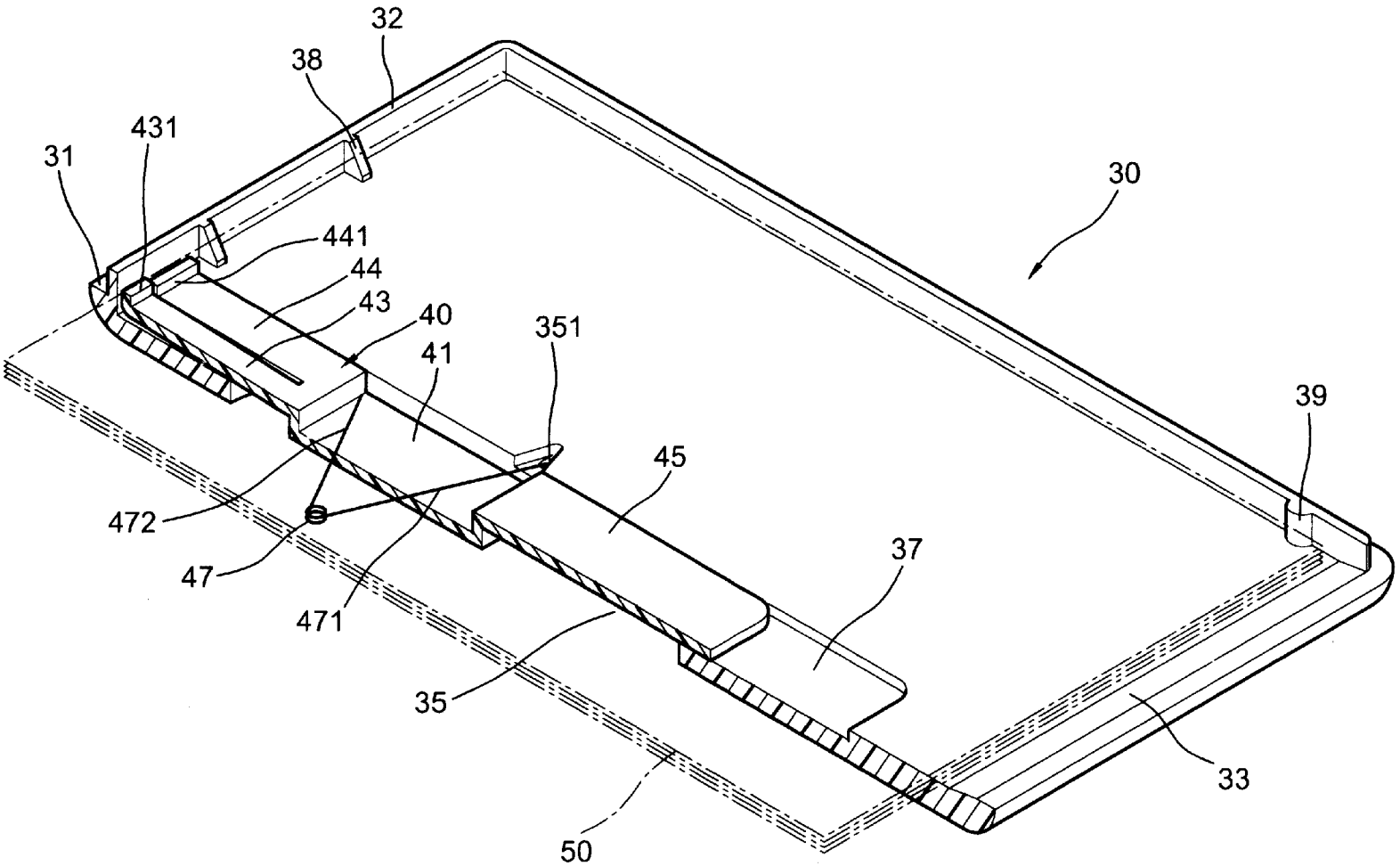
Figure 4:
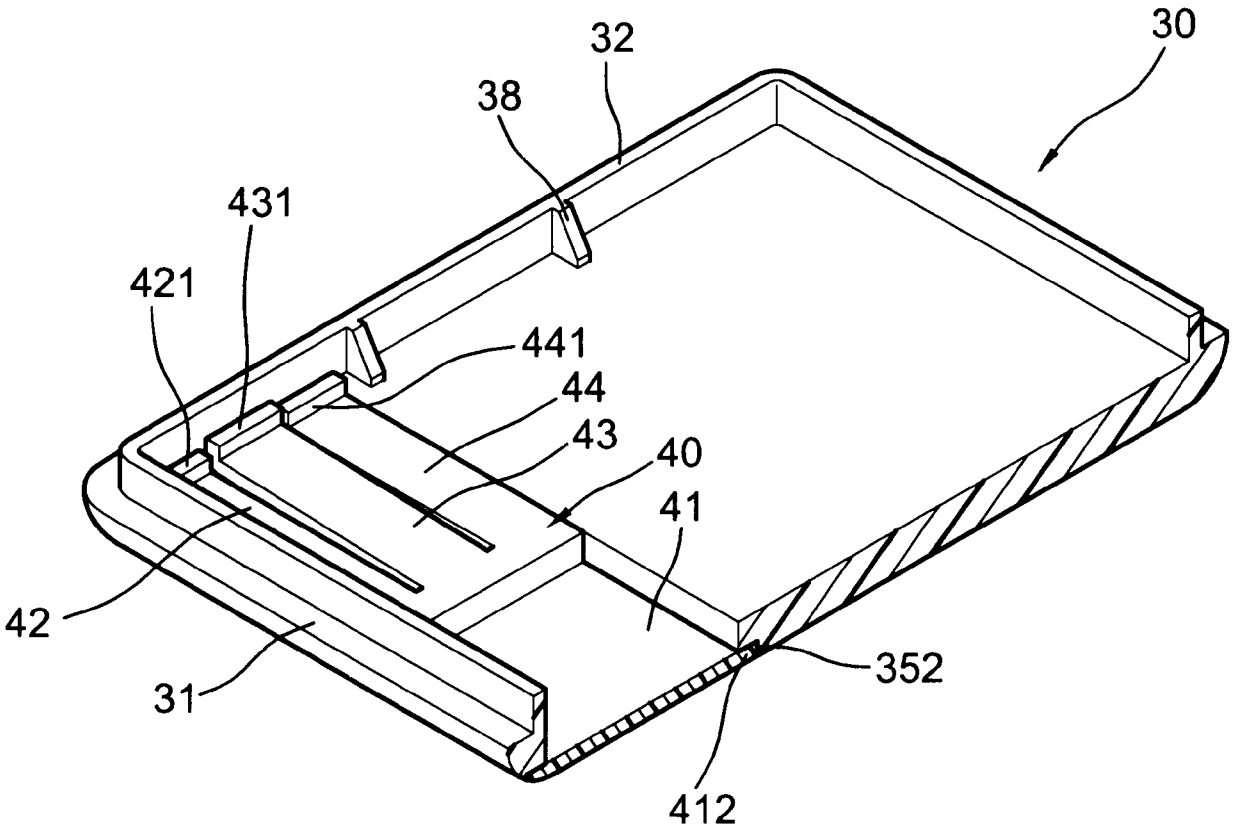
Figure 5:
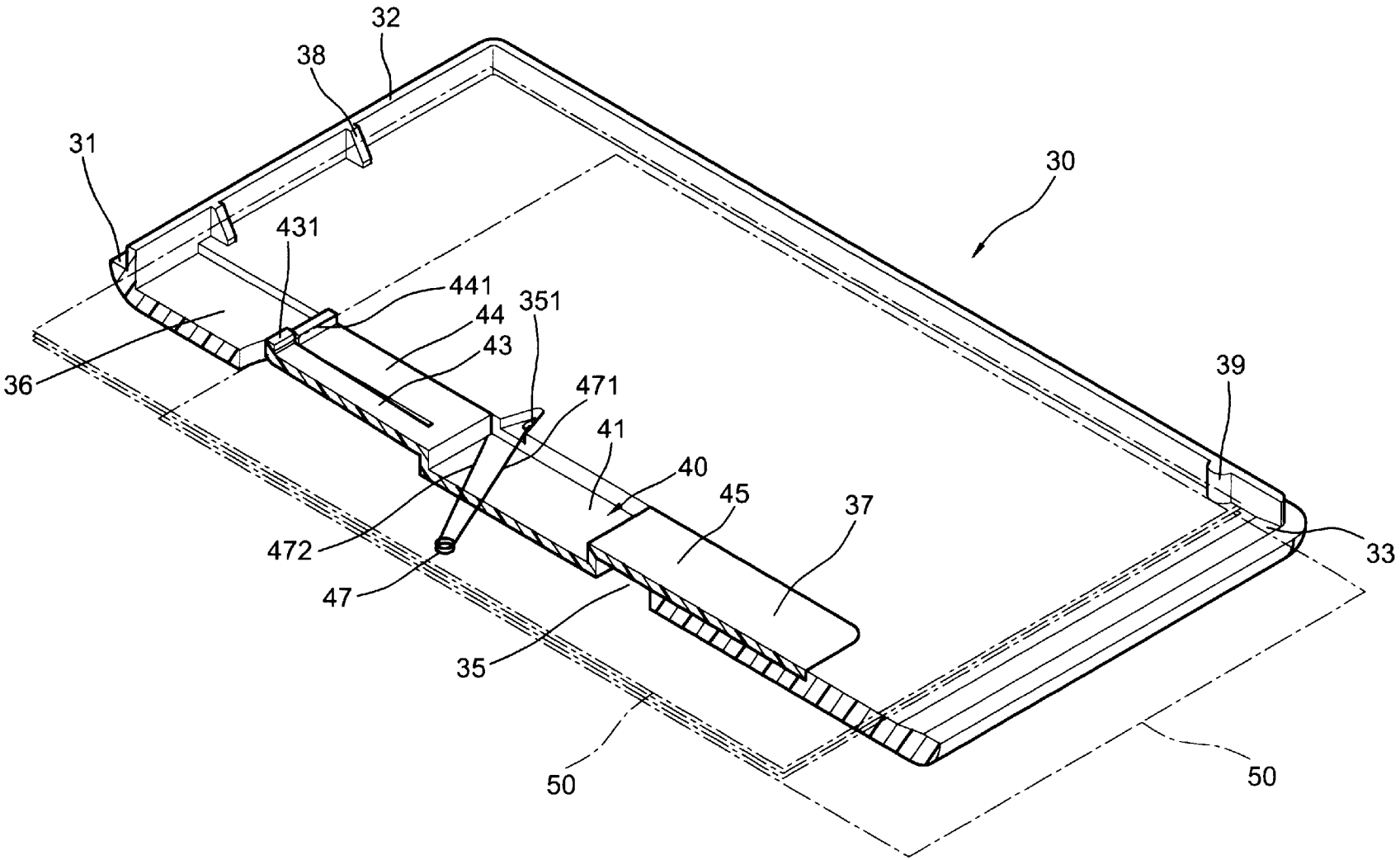
Figure 6:
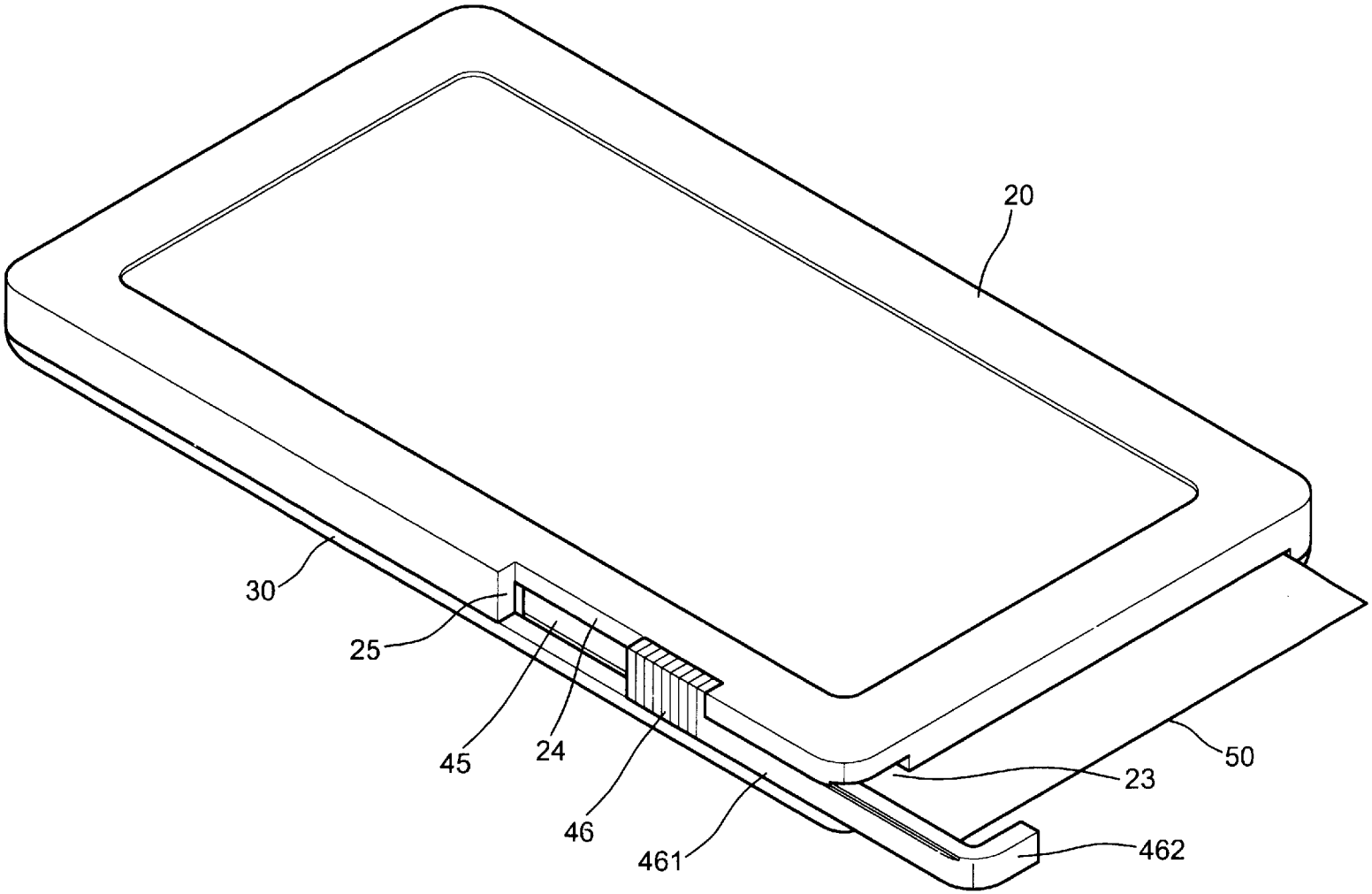
Figure 7:
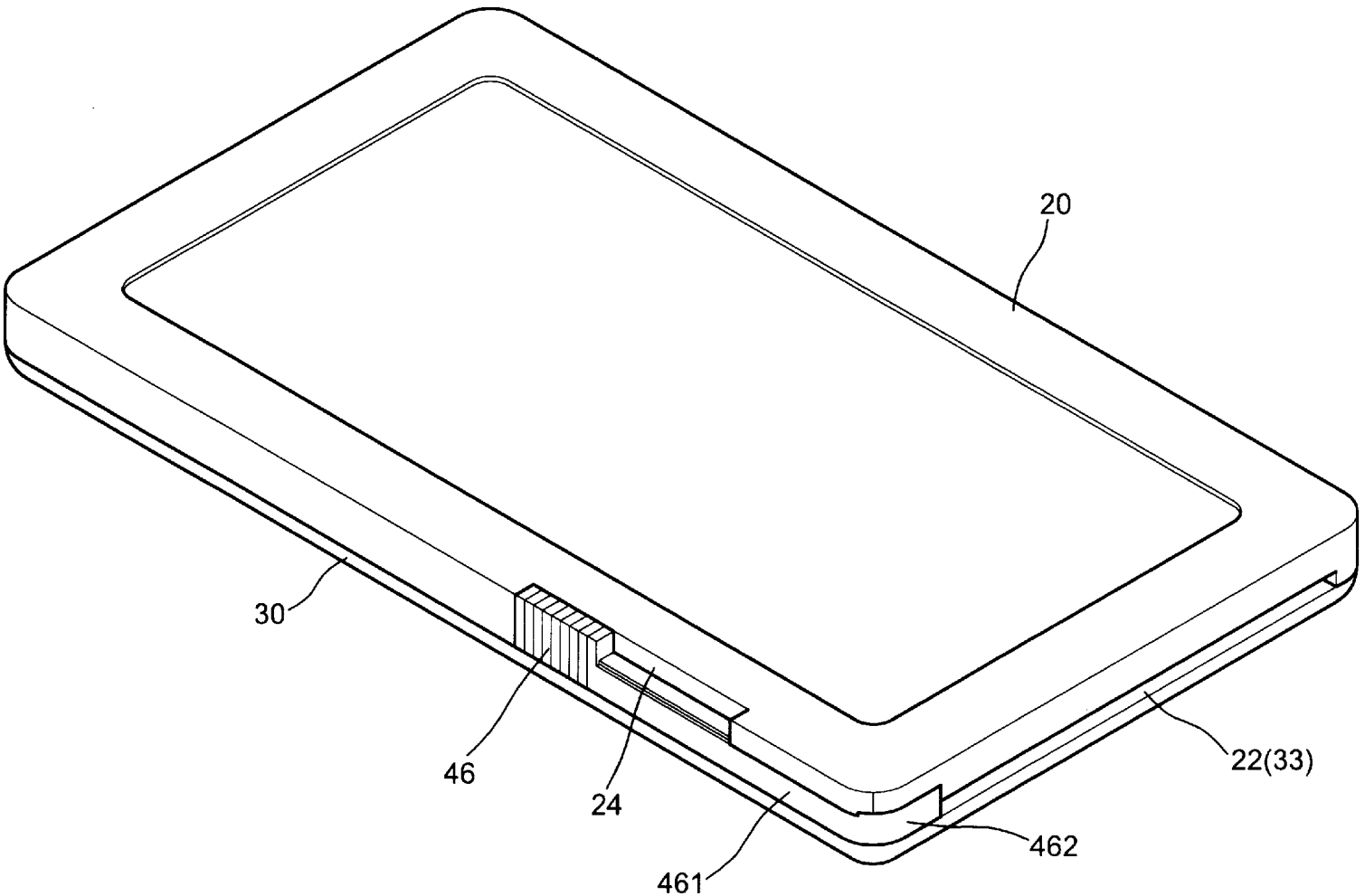

FIG. 1 is an exploded perspective view of a name cards box,

FIG. 2 is an exploded perspective view of the present invention of a name cards box, FIG. 3 is partial perspective sectional view of combination of a sliding piece and a bottom box of the present invention of a name cards box, FIG. 4 is a perspective sectional view of the two sides of a main board being placed on a shallower area of a bottom box of the present invention of a name cards box, FIG. 5 is perspective sectional view of the present invention of a name cards box when a sliding piece is in motion, FIG. 6 is a perspective view of the present invention of a name cards box when name cards are being pushed out, and FIG. 7 is a perspective view of the present invention of a name cards box when a rod and a stopping piece are returned back to the original positions.

DETAILED DESCRIPTION OF THE PREFERRED EMBODIMENT

The present invention of a name cards box structure as shown in FIG. 2, it mainly comprises a top cover 20, a bottom box 30 and a sliding piece 40. A circumference edge 21 is extended downwards from the sides of the top cover 20, with a slit opening 22 is disposed at one side of the circumference edge 21. The slit opening 22 is a little shallower than the circumference edge 21 for taking out name cards. An indented opening 23 is located at the corner next to the slit opening 22, a little width of the circumference edge 21 is taken away from the indented opening 23. The indented opening 23 is extended in a L shape and having a trough 24. The trough 24 is indented and elongated in shape on the top cover 20. A stopping edge 25 is disposed at each end of the trough 24. A convex edge 31 and a circumference frame 32 protruded upwards are on the sides of the bottom box 30. The circumference frame 32 can match with the circumference edge 21 of the top cover 20 so that the top cover 20 and the bottom box 30 are combined together. A slit 33 without the circumference frame 32 is disposed on one side of the bottom box 30, the surface of the slit 33 is bent a little upwards. No circumference frame 32 is on the bottom box 30 in correspondence to the trough 24. A hole 35 in elongated shape is disposed on the bottom surface of the bottom box 30. Lower areas 36 and 37 are disposed at both ends of the hole 35 in corresponding places. A hooking hole 351 is placed on one of the lengths of the hole 35. Two inclined blocks 38 and two cylindrical pillars 39 are disposed inside the circumference frame 32 of the bottom box 30 for positioning name cards. The sliding piece 40 is placed inside the hole 35 of the bottom box 30 and on the lower areas 36 and 37. The sliding piece 40 has a main board 41 which is a little lowered. The main board 41 can be placed inside the hole 35. The main board 41 has three hooks 42, 43 and 44, hooks 42, 43 and 44 having hooking ends 421, 431 and 441 respectively. The hook 43 which is in the middle is a little bent upwards for hooking name cards. Convex dots can be designed on the bottom of the hook 43 for convenience of pushing by fingers. A flat board 45 is at the opposite end of the main board 41 and is placed on the lower area 37 of the bottom box 30. A block 46 is disposed on one length of the flat board 45, a rod 461 is extended from the end of the block 46, the rod 461 is bent at the end to form a stopping piece 462, so that the stopping piece 462 and the rod 461 are in L shape. The side of the stopping piece 462 facing name cards having an inclined surface 4621, means the nearer it gets to the end of the stopping piece 462, the thicker it is. A protruded rod 411 is disposed on the main board 41 and is enclosed by a V-shaped spring 47. Two lines 471 and 472 are extended from the V-shaped spring 47, and the end 4711 of the line 471 is bent downwards to go inside the hooking hole 351 of the bottom box 30, the other line 472 is hooked on the side wall of the hooks 42, 43 and 44.

Accordingly, as shown in FIGS. 2, 3, 4 and 7, the sliding piece 40 is inside the hole 35 of the bottom box 30 and on the lower areas 36 and 37. The width of the main board 41 is a little wider than the width of the hooks 42, 43 and 44 all together, and is also a little wider than the width of the flat board 45, so that the side 412 of the main board 41 can be placed inside a shallower area 352. The block 46 is placed in between the two stopping edges 25 of the top cover 20 and the stopping piece 462 is placed on the slit 33 of the bottom box 30 partially. The spring 47 is assembled on the sliding piece 40 and inside the bottom box 30. When name cards 50 are placed inside the bottom box 30 and the top cover 20 is put on its top, then the main board 41 is pushed by fingers. As shown in FIGS. 5 and 6, the hooking end 431 of t he hook 43 is used to hook the name card 50 so that the name card 50 is being pushed out by the sliding piece 40 from between the slit opening 22 of the top cover 20 and the slit 33 of the bottom box 30. The block 46 is moved in between the trough 24 of the top cover 20 and the two stopping edges 25 when the sliding piece 40 is moved. When the stopping piece 462 is no longer blocking the indented opening 23, the slit opening 22 and the slit 33, but is sticking outside the top cover 20 and the bottom box 30, the name card 50 can then be pushed outside a little bit, and users can take the name card 50 out by forcing a little upwards or upwards with fingers in order to stay away from the stopping piece 462. If the name card 50 has already been bent inside the name cards box, simply push the hooking end 431 upwards to get hold of the name card 50. The purpose of the hooks 42, 43 and 44 is for hooking the name card 50. The inclined surface 4621 of the stopping piece 461 can stop more than one name card from coming out which can accomplish the purpose of getting out a name card 50 on the bottom. The number of name cards being gotten out can be adjusted by the pressure a user applies on the hooking end 431. The higher the hooking end is being pushed upwards, the more name cards can be gotten out and vice versa.

When fingers are away from the main board 41 of the block 46, the sliding piece 40 will return to its original position by the elasticity provided by the spring 47. When the stopping piece 462 is again blocking the slit opening 22 and the slit 33, extra name cards which protruded outside the slit opening 22 will be pushed back inside. The bottom box 30 can also accommodate memos, cards and other alternatives. It can be made with different depth to hold more cards.

Although the invention has been explained in relation to the preferred embodiment, it is to be understood that many other possible modifications and variations can be made without departing from the spirit and scope of the invention as hereinafter claimed.

I claim:

1. A name cards box structure comprising a top cover, in which a circumference edge is extended downwardly from the sides of the top cover, a slit opening is disposed on one of the sides of the circumference edge, the slit opening is a shallower than the rest of the circumference edge for getting out name cards, an indented opening is at the corner next to the slit opening, a trough is next to the indented opening further comprising; a bottom box, in which a convex edge and a circumference frame are extended upwardly from the sides of the bottom box, the circumference edge of the top cover can mount on the circumference frame of the bottom box, a slit is disposed on the bottom box in correspondence to the slit opening of the top cover, the section in correspondence to a trough has no circumference frame, a stopping edge is disposed by each end of the trough, a hole is disposed on a preset place on the bottom of the bottom box, two ends by the hole are a recessed, and a shallower area is disposed around the hole further comprising; a sliding piece for placing inside the hole and on the recessed areas by the two ends of the hole, the sliding piece having a main board on a lower level, in which three hooks are disposed at one end of the main board, each hook has a hooking end, one of the hooks is a little bent upwards, a flat board is disposed oppositely to the main board, a block is disposed on the outer side of the flat board, a rod is extended from the block and ends as a bent stopping piece, the stopping piece can go in and out of the indented opening of the top cover, the block moves within the trough and is limited by the stopping edges of the top cover, the sliding piece is moved by fingers within the hole of the bottom box so that the stopping piece is not blocking the intended opening, and the name cards are hooked outwardly from between the slit opening of the top cover and the slit of the bottom box by the hooks, thus it is convenient to get out name cards and push back any extra name cards into the name cards box.

2. The present invention of a name cards box structure as claimed in claim 1 wherein the main board of the sliding piece has a protruded rod for positioning, a hooking hole is disposed by one side of the hole of the bottom box, a V-shape spring is adapted to be inserted onto the protruded rod and the hooking hole, two lines are extended from the V-shape spring, the spring encloses the protruded rod and one of the lines is inserted into the hooking hole, and the other line is pressed against the hooks to provide elasticity for the sliding piece returns back to its original position.

3. The present invention of a name cards box structure as claimed in claim 1 wherein the stopping piece has an inclined surface on the side facing the sliding piece to block any extra name cards from coming out.

* * * * *